United States Patent [19]

Murphy

[11] Patent Number: 5,069,411

[45] Date of Patent: Dec. 3, 1991

[54] PICTURE HANGER

[76] Inventor: James P. Murphy, 2817 Stutz Dr., Midland, Tex. 79705-4929

[21] Appl. No.: 595,291

[22] Filed: Oct. 10, 1990

[51] Int. Cl.[5] ..... A47G 1/24

[52] U.S. Cl. ..... 248/476; 248/287; 248/495

[58] Field of Search ..... 248/476, 495, 475.1, 248/323, 287, 477, 480, 448, 449; 40/152.1

[56] References Cited

U.S. PATENT DOCUMENTS

| | | | |
|---|---|---|---|
| 1,107,686 | 8/1914 | Mehrmann | 248/495 |
| 1,745,574 | 2/1930 | Hoegger | 248/475.1 |
| 1,815,767 | 7/1931 | Fusmer | 248/475.1 |
| 2,297,790 | 10/1942 | Miller | 248/476 |
| 2,681,194 | 6/1954 | Halvorsen | 248/495 |
| 2,905,412 | 9/1959 | Kipp | 248/495 X |
| 2,952,431 | 9/1960 | Pedley | 248/495 |
| 4,549,713 | 10/1985 | Magadini | 248/495 |
| 4,934,077 | 6/1990 | Gerlach | 248/480 |

*Primary Examiner*—Ramon O. Ramirez

*Attorney, Agent, or Firm*—Johnson & Gibbs

[57] ABSTRACT

An adjustable picture hanger including a fixed length or a two-piece, adjustable, horizontal bar formed of two bar members having longitudinal slots and secured together by screw assemblies through the slots, holes in opposite ends of the horizontal bar for attaching the horizontal bar to a wall surface, and two vertical, horizontally spaced bars each having longitudinal slots and attached with screw assemblies to the horizontal bar members through the longitudinal slots in the horizontal bar members for vertical and horizontal adjustment of the vertical bars, and a picture hanger bracket screw along the upper end portion of each of the vertical bars for hanging the picture having two spaced hanger brackets along the back of the picture. The adjustable picture hanger may be made of lathe members which are rectangular in cross section or may be constructed of channel-shaped members forming either the horizontal and/or the vertical bars. The picture hanger is adjustable to picture size and permits adjustment of the level of the picture by adjusting the vertical bars.

4 Claims, 1 Drawing Sheet

PICTURE HANGER

BACKGROUND OF THE INVENTION

This invention relates to the picture hangers and more particularly a picture hanger adjustable to both a picture size and picture hanging attitude.

HISTORY OF THE PRIOR ART

In the past, there have been a number of adjustable picture hangers made to fit various size pictures and having feature permitting the attitude or level of a picture to be adjusted.

U.S. Pat. No. 1,107,686 issued to Mehrmann, Aug. 18, 1914, shows a hanger for supporting picture frames from a ceiling molding. The frame includes a single vertical adjustable bracket connected at a lower end to a crossbar adjustable in length. No structure is provided for adjusting picture level.

U.S. Pat. No. 1,745,574 issued to Hoegger Feb. 4, 1930, shows a picture hanger having a single adjustable vertical member, a cross member attached to the upper end of the vertical member, and end brackets for attachment to a picture frame. The horizontal cross member is not adjustable for picture level or picture size.

U.S. Pat. No. 2,681,194 issued Jan. 20, 1950 to Halvorsen shows a pendulum type vertical member for picture level control and a horizontal member secured to the vertical member having adjustable end brackets for attachment to a variety of picture frame widths.

U.S. Pat. No. 2,905,412 issued Sept. 22. 1959 to Kipp shows a hanging apparatus for mirrors, pictures, and the like, including two vertical adjustable brackets in one embodiment and three adjustable brackets in another form for attachment to mirrors, pictures and the like for hanging on a wall. Features for adjusting picture level are not included in the device.

U.S. Pat. No. 2,952,431 issued Sept. 13, 1960 to Pedley shows a picture hanger having a single vertical member, adjustable in one alternate embodiment, and a single horizontal member. The device has picture leveling means at the bottom of the vertical member for shifting the position of the bottom of the picture to adjust the picture level.

None of the known prior patents discloses Applicant's structure for supporting and adjusting a picture to a level position on a surface such as a wall.

SUMMARY OF THE INVENTION

It is, therefore, an object of the invention to provide a new and improved picture hanger.

It is another object of the invention to provide a picture hanger which may be adjusted to pictures of various widths.

It is another object of the invention to provide a picture hanger which permits the level of the picture to be adjusted.

It is another object of the invention to provide a picture hanger having moveable parts which may be adjusted and firmly secured for supporting a picture at a desired attitude.

It is another object of the invention to provide a picture hanger which is simple in construction and inexpensive to manufacture.

In accordance with the invention, there is provided a picture hanger having a horizontal member which may be of fixed or adjustable length and spaced vertical members secured to the horizontal member and adjustable vertically and horizontally to accommodate a variety of picture sizes and for picture levelling. Each of the vertical members includes a fitting for attachment of a hanger bracket to the picture hanger.

BRIEF DESCRIPTION OF THE DRAWINGS

The foregoing objects and advantages together with specific preferred embodiments of the picture hanger of the invention will be better understood from the following detailed description taken in conjunction with the accompanying drawings, wherein.

A DETAILED DESCRIPTION OF THE PREFERRED EMBODIMENTS

Figure 1:
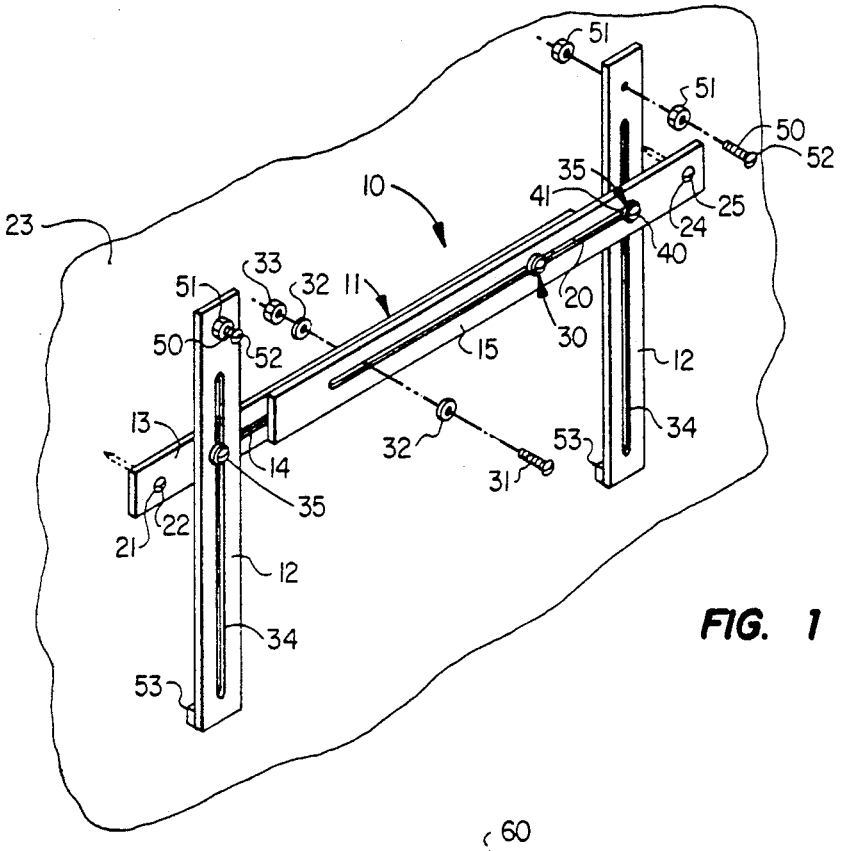
FIG. 1 is a perspective view of a preferred form of picture hanger embodying the features of invention, illustrating the hanger along a wall surface.

Referring to the drawings, a picture hanger 10 constructed in accordance with the invention includes a horizontal bar assembly 11 and spaced vertical bars 12. The bar assembly 11 is adjustable in length for a variety of picture sizes. The vertical bars 12 are adjustable on the bar assembly 11 to correctly level a picture mounted on the picture hanger.

The horizontal bar assembly includes a bar member 13 having a longitudinal slot 14 and a bar member 15 having a longitudinal slot 20. The bar member 13 is also provided with a hole 21 along an outer end portion of the bar member for a nail or screw 22 to attach the face end of the bar member to a wall 23. Similarly, the bar member 15 has a hole 24 along an outer end portion for a nail or a screw 25 for attachment of the bar 15 to the wall 23.

The bar members 13 and 15 are attached together for longitudinal length adjustment by screw assemblies 30 which include a screw 31, washers 32, and a nut 33. The screw 31 extends through the slot 20 in the member 15 and the slot 14 in the member 13. One of the washers 32 is positioned on the shank of the screw on the front of the member 15, while the other washer 32 is positioned on the screw shank along the back face of the member 13 so that when the nut 33 is tightened on the screw shank the members 13 and 15 are tightly clamped together between the washers 32. The use of the two screw assemblies 30 connected through the slots in the horizontal bar members readily permits the sliding adjustment of the two bar members so that the length of the bar assembly 11 is easily changed to adjust the picture hanger to various picture widths. Each of the vertical bars 12 has a longitudinal slot 34 for attachment of the vertical bar to the horizontal bar assembly. Each vertical bar 12 is connected to the vertical bar assembly by a screw assembly 35 including a screw 40, two washers 41, and a nut, not shown. The screw assembly 35 may be made of the same size and type of screws, washers, and nuts as the screw assemblies 30. As seen in the FIG. 1 and 2, the left vertical member 12 is adjustably attached to the horizontal bar member 13 by a screw assembly 35 which connects through the slot 34 in the member 12 and the slot 14 in the bar member 13 permitting the vertical position of the left vertical bar member 12 to be adjusted relative to the horizontal bar assembly. Similarly, the right vertical bar 12 is adjustably connected with the horizontal bar member 15 by a screw assembly 35 attached through the slot 20 in the horizontal bar member 15 and the slot 34 in the right bar 12 permitting vertical height adjustment of the right bar 12 relative to the horizontal bar assembly 11. A picture mounting or hanger screw 50 is secured along the upper end portion of each of the vertical bars 12 by a pair of nuts 51 on the screws 50 at the front and back of each bar member 12 clamping the screws 50 to the bar members. The screws 50 are mounted so that the screw head 52 of each of the screws is spaced in front of the front washer 51 on each of the vertical bars for mounting a picture on the hanger 10, as described hereinafter. A pad 53, of felt, rubber, or the like, is secured as by cementing across the back face of the lower end of each member 12. The thicknesses of the pads 53 are varied to permit the hanger 10 to rest flat against a wall.

Figure 2:
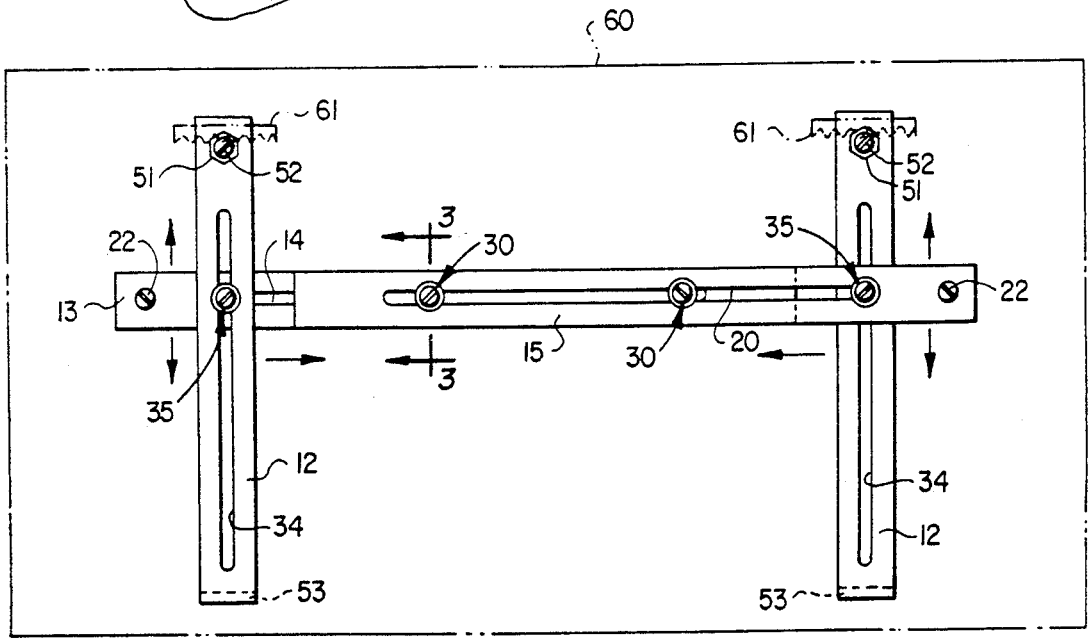
FIG. 2 is a front view in elevation of the picture hanger of FIG. 1, showing in phantom lines a picture mounted on the hanger.
Figure 3:
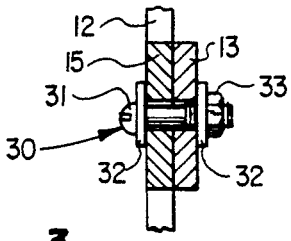
FIG. 3 is a view in section along the line 3—3 of FIG. 2.

In operation, the hanging of a picture on a wall surface 23 using the picture hanger 10 of the invention is illustrated in FIG. 2, where the picture and hanger brackets on the picture are represented in the phantom lines. First, the various parts of the picture hanger 10 are assembled in the relationship shown in FIGS. 1 and 2. The horizontal bar members 13 and 15 are attached together using the nut and bolt assemblies 30 secured through the longitudinal slots in the members 13 and 15, as previously described. The left and right vertical bars 12 are mounted on the horizontal bar members 13 and 15, respectively, using the screw and nut assemblies 35. The picture hanger is adapted to the size of the picture 60 for the proper spacing of the vertical bars 12 to fit to the spacing of hanger brackets 61 on the back of the picture 60. The adjustment between the vertical bars 12 may be accomplished by both the adjustable positioning of the vertical bars along the horizontal bar members and the adjustment of the length of the bar 11 by the relative positioning of the horizontal bar members 13 and 15. The adjusting of the positions of the vertical bars 12 on the horizontal bar 11 and the length of the horizontal bar assembly 11 are determined by the distance between the picture brackets 61, which are mounted on the frame of the picture 60 along the top horizontal the member of the frame. For the maximum stable mounting of the picture 60 on the picture hanger 10, the length of the horizontal bar assembly and the positions of the vertical bars 12 on the horizontal bar assembly are adjusted to positions at which the horizontal bars 12 are as near to the ends of the horizontal bar members 13 and 15 as possible and the horizontal bar assembly is near the upper ends Of the vertical bars 12. The picture hanger is then attached to the wall 23 by the nails or screws 22 which pass through the hole 21 in the horizontal bar member 13 and the hole 24 in the horizontal bar member 15. The length of the bar assembly 11 obviously must be determined and the screw and nut assemblies 30 tightened before mounting the hanger on the wall. Once the horizontal members 13 and 15 are securely attached to the wall by the screws or nails 22 and 25, the length of the bar assembly 11 can no longer be adjusted.

It will be recognized when adjusting the picture hanger to the picture size, the picture hanger is adjusted so that no portion of the picture hanger members will be visible from the front of the picture Obviously a picture hanger 10 would not be selected which has the vertical bars 12 longer than the height of the picture. Similarly, the length of the adjustable horizontal bar assembly 11 and the positions of the vertical bars 12 on the horizontal bar assembly 11 will be adjusted to minimize the possibilities of seeing the picture hanger from the front and at the ends of the picture.

After the picture hanger 10 is securely mounted on the wall 23, the picture 60 is placed on the hanger by resting the two picture hanger brackets 61 on the back of the picture on the screws 50 between the screw heads 52 and the washers 51 on the front of the vertical bars 12 of the picture hanger. As evident in FIG. 2, the serrated bottom edge of the hanger brackets 61 enable the brackets to rest on the picture hanger screw shanks 50 with the screw shanks each fitting in one of the downwardly opening V-notches of the hanger brackets. Before placing the picture on the picture hanger, the vertical positions of screws 50 will be adjusted along a level line, as nearly as possible. After the picture 60 is placed on to the hanger, if the picture is not level, one or the other of the vertical bars 12 is readily adjusted to raise or lower the bar by loosening and then retightening the appropriate screw assembly 35 attaching the vertical bar 12 being adjusted to the horizontal bar member, 13 or 15, as the case may be. Once the picture 60 is hung on the picture hanger 10, the fact that two spaced hanger brackets 61 are used will keep the picture level so long as the screw assemblies 35 attaching the vertical bars 12 to the horizontal bar assembly 11 remain tight. If one of the screw assemblies 35 should loosen enough to allow one of the vertical bars 12 to drift enough for the picture to cease to be level, the picture can readily be re-leveled by repositioning the vertical bar 12 in question and re-tightening the screw assembly 35.

Figure 4:
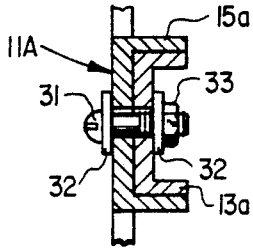
FIG. 4 is a view in section similar to FIG. 3 of another embodiment of the picture hanger.

An alternate form of the horizontal bar assembly of the picture hanger is illustrated in FIG. 4 and referred to by the reference 11A. The horizontal bar assembly includes a horizontal bar member **13*a* and a horizontal bar member 15*a*, both of which are channel-shaped in cross section so that the bar members mesh or fit together as shown in FIG. 4. The use of the alternate form of horizontal bar members illustrated in FIG. 4 can increase the rigidity of the horizontal bar assembly as well as permitting the assembly to rest more firmly against the front surface of a wall. If desired, When using the channel-shaped members illustrated in FIG. 4, the vertical bars 12**, similarly, may be made of channel-shaped material.

It will be apparent that a still further embodiment of the picture hanger of the invention may include a one-piece, horizontal bar in place of the adjustable length bar assembly 11. Such a single horizontal bar would include a longitudinal slot with the vertical bars 12 and related structure being identical to and mounted in the same manner as illustrated in the drawings. While such an embodiment would provide less adjustability for accommodating different picture sizes, the vertical bar member 12 could still be adjusted horizontally to accommodate the picture hanger to picture sizes compatible with the length of the fixed horizontal bar.

The picture hanger 10, as illustrated and described, may be fabricated of a wide variety of materials, such as wood lathe, metal bar members, and available plastics.

It would be seen that a new and improved picture hanger has been described and illustrated. The picture hanger is readily adjustable to a variety of picture sizes. The picture hanger is readily adjustable to level a picture. Further, when a picture supported on the hanger ceases to be level, due to some loosening of one of the hanger members, the hanger may readily be readjusted and tightened to return the picture to a level attitude. The hanger is simple in construction and can be manufactured and assembled at minimum cost.

What is claimed is:

1. An adjustable picture hanger comprising;

an adjustable horizontal bar assembly including a first flat horizontal bar member having a single longitudinal slot extending a major portion of the length of said bar member, a second flat horizontal bar member having a single longitudinal slot extending a major portion of the length of said bar member, a plurality of screw assemblies secured in spaced relation through said slots in said first and second horizontal bar members holding said bar members together in juxtapose relation with opposite side edges of said bar members in alignment whereby said bar members are relatively adjustable to adjust the length of said horizontal bar assembly, and each of said bar members having hole means in opposite end portions of said bar members for attachment of said bar assembly to a supporting surface;

a first vertical bar having a longitudinal slot therein; a screw assembly through said slot in said vertical bar and said slot in said first horizontal bar member securing first vertical bar with said first horizontal bar member in adjustable relation;

a picture hanger screw having an enlarged head along an upper end of portion said first vertical bar for attaching a first picture hanger bracket on said upper end portion of said first vertical bar;

a second vertical bar having a longitudinal slot therein;

a screw assembly through said slot in said second vertical bar and said slot in said second horizontal bar member securing said second vertical bar with said second horizontal bar member in adjustable relation and in spaced relation from said first vertical bar;

a picture hanger screw having an enlarged head along an upper end portion of said second vertical bar for attaching a second picture hanger bracket on said upper portion of said second vertical bar; and a pad across the back face of a lower end portion of each vertical bar sized to position said picture hanger first along a wall.

2. An adjustable picture hanger in accordance with claim 1 wherein said first and second horizontal bar members and said first and second vertical bars are rectangular in cross section.

3. An adjustable picture hanger in accordance with claim 1 wherein said first and second horizontal bar members include edge flanges defining a channel-shaped cross section and sized to mesh together and said first and second vertical bars are rectangular in cross section.

4. An adjustable picture hanger in accordance with claim 1 wherein said first and second horizontal bar members include edge flanges defining a channel-shaped cross section and sized to mesh together to form said adjustable horizontal bar assembly and said first and second vertical bars include edge flanges defining a channel-shaped cross section.

* * * * *